United States Patent [19]

Eylon et al.

[11] Patent Number: 4,820,360

[45] Date of Patent: Apr. 11, 1989

[54] METHOD FOR DEVELOPING ULTRAFINE MICROSTRUCTURES IN TITANIUM ALLOY CASTINGS

[75] Inventors: Daniel Eylon, Dayton; Francis H. Froes, Xenia, both of Ohio; Charles F. Yolton, Coraopolis, Pa.

[73] Assignee: The United States of America as represented by the Secretary of the Air Force, Washington, D.C.

[21] Appl. No.: 128,839

[22] Filed: Dec. 4, 1987

[51] Int. Cl.[4] ..... C22F 1/18

[52] U.S. Cl. ..... 148/133; 148/13.1; 148/20.3

[58] Field of Search ..... 148/13.1, 20.3, 133

[56] References Cited

U.S. PATENT DOCUMENTS

| | | | |
|---|---|---|---|
| 2,892,742 | 6/1959 | Zwicker et al. | 148/11.5 |
| 4,415,375 | 11/1983 | Lederich et al. | 148/11.5 |
| 4,505,764 | 3/1985 | Smickley et al. | 148/133 |
| 4,612,066 | 9/1986 | Levin et al. | 148/133 |
| 4,680,063 | 7/1987 | Vogt et al. | 148/11.5 F |

OTHER PUBLICATIONS

W. R. Kerr et al, "Hydrogen as an Alloying Element in Titanium (Hydrovac)", *Titanium '80 Science and Technology*, (1980), pp. 2477-2486.

*Primary Examiner*—Upendra Roy

*Attorney, Agent, or Firm*—Charles E. Bricker; Donald J. Singer

[57] ABSTRACT

A method for improving the microstructure of cast titanium alloy articles which comprises the steps of hydrogenating the cast article at a temperature near or above the titanium-hydrogen eutectoid of 815° C. (of about 780° to 1020° C.) to a hydrogen level of about 0.50 to 1.50 weight percent, cooling the thus-hydrogenated article to room temperature at a controlled rate, heating the thus-cooled, hydrogenated article to a temperature of about 650° to 750° C., applying a vacuum to dehydrogenate the article, and cooling the thus-dehydrogenated article at a controlled rate.

6 Claims, 1 Drawing Sheet

METHOD FOR DEVELOPING ULTRAFINE MICROSTRUCTURES IN TITANIUM ALLOY CASTINGS

RIGHTS OF THE GOVERNMENT

The invention described herein may be manufactured and used by or for the Government of the United States for all governmental purposes without the payment of any royalty.

BACKGROUND OF THE INVENTION

This invention relates to titanium alloy castings. In particular, it relates to a method for improving the microstructure of titanium alloy castings.

Titanium and titanium alloys are extremely valuable in uses where light weight and high strength-to-weight ratio are important. The casting of titanium and titanium alloys presents a special problem due to the high reactivity of the material in the molten state. This requires special melting, mold-making practices, and equipment to prevent alloy contamination. At the same time, titanium castings present certain advantages when compared to castings of other metals. The microstructure of as-cast titanium is desirable for many mechanical properties. It has good creep resistance, fatigue crack growth resistance, fracture resistance, and tensile strength. Titanium alloy castings also readily lend themselves to full densification by hot isostatic pressing (HIP) because they dissolve their own oxides at high temperatures allowing a complete closure of all non-surface-connected, i.e., non-gas filled, voids by diffusion bonding. However, on the debit side, some mechanical properties of cast parts, particularly those which are crack initiation-related, such as smooth fatigue, are currently inferior to those exhibited by ingot metallurgy (IM) parts.

The melting practice used for cast-part production is essentially the same as for alloy ingot melting. Accordingly, it is possible to cast all titanium alloys produced by ingot metallurgy. The major difference between ingot metallurgy and cast metallurgy parts stems from the subsequent hot working and heat treatment of ingots or their products, which allows microstructural manipulations not possible in the cast part, such as, for example, equiaxed recrystallized alpha.

Smickley et al, U.S. Pat. No. 4,505,764 (Mar. 19, 1985) disclose treatment of the microstructure of titanium alloy castings which comprises the steps of heating the casting to a treatment temperature of about 800° to 2000° F., the treatment temperature being below the beta transus temperature of the alloy, diffusing hydrogen into the casting at treatment temperature such that hydrogen is present in an amount ranging from 0.2 to 5.0 wt. percent, and removing the hydrogen. The method of Smickley et al requires maintaining the temperature of the casting above the temperature at which metal hydrides would be formed when hydrogen is present in the casting in more than trace amounts. Smickley et al disclose that cooling the hydrogenated casting to about room temperature wherein significant amounts of titanium hydride could form, results in cracking and distortion of the casting. A major drawback of the method of Smickley et al is the requirement for a relatively sophisticated apparatus, capable of performing both hydrogenation and dehydrogenation.

Levin et al, U.S. Pat. No. 4,612,066 (Sept. 16, 1986) disclose treatment of the microstructure of titanium alloy castings which comprises the steps of beta-solution heat treating the casting, rapidly cooling the casting to room temperature, hydrogenating the casting at a temperature below the beta-transus and dehydrogenating the casting. The beta-solution heat treatment followed by rapid cooling can lead to component cracking or distortion.

Hydrogen has also been used to increase the high temperature ductility of titanium alloys. Lederich et al, U.S. Pat. No. 4,415,375 (Nov. 15, 1983) disclose a method for superplastically forming titanium and titanium alloys which comprises treating a stock piece of titanium or titanium alloy with hydrogen to form a transient alloy containing hydrogen, superplastically forming the hydrogen containing piece, and thereafter, removing the hydrogen from the formed piece.

Zwicker et al, U.S. Pat. No. 2,892,742 (June 30, 1959) disclose a process for hot working of titanium alloys which comprises incorporating about 0.05 to 1 weight percent of hydrogen into such alloys, hot working the hydrogen-containing alloys, and removing the hydrogen therefrom after the hot working has been completed.

Although Zwicker et al and Lederich et al have disclosed that hydrogen is beneficial as a transient alloying element for improving the hot workability and superplasticity of titanium and its alloys, pure titanium and many titanium alloys are embrittled at room temperature by the presence therein of only very small quantities of hydrogen. This embrittlement causes a lowered impact resistance. In order to obtain good mechanical properties at room temperature, it is necessary to remove the hydrogen therefrom after hot working or superplastic forming has been completed.

Further, the improved hot workability of titanium alloys containing hydrogen does not extend to alloys which are temporarily alloyed with hydrogen, then dehydrogenated under vacuum prior to hot forging. W. R. Kerr et al, "Hydrogen as an Alloying Element in Titanium (Hydrovac)". *Titanium* '80 *Science and Technology*, (1980) pp 2477–2486.

It is an object of this invention to provide a method for improving the microstructure of cast titanium alloy articles.

Other objects and advantages of the present invention will be apparent to these skilled in the art from a reading of the following detailed description of the invention.

SUMMARY OF THE INVENTION

In accordance with the present invention, there is provided a method for improving the microstructure of cast titanium alloy articles which comprises the steps of hydrogenating the cast article at a temperature of about 780° to 1020° C. to a hydrogen level of about 0.50 to 1.50 weight percent, cooling the thushydrogenated article to room temperature at a controlled rate, heating the thus-cooled, hydrogenated article to a temperature of about 650° to 759° C. and applying a vacuum to dehydrogenate the article.

DETAILED DESCRIPTION OF THE INVENTION

Figure 1:
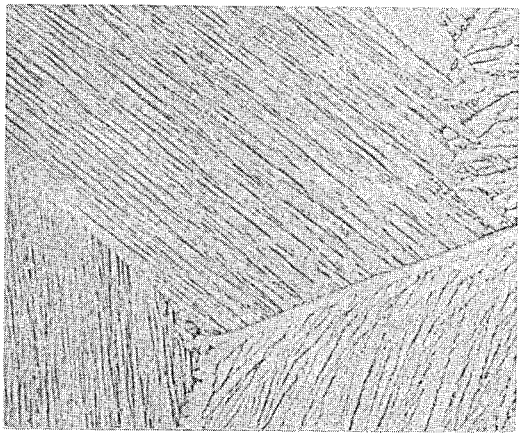
FIGS. 1–6 are 500x microphotographs of Ti-6Al -4V cast coupons illustrating various levels of treatment.

The titanium alloys which may be employed according to the present invention are the near-alpha, alpha-beta and near-beta alloys. Suitable alloys include, for example, Ti-5Al -6Sn-2Zr-1Mo-0.2Sn, Ti-6Al -2Sn-4Zr-2Mo-0.1Si, Ti-6Al -4V, Ti-6Al -6V-2Sn, Ti-6Al -2Sn-4Zr-6Mo, Ti-5Al -2Sn-2Zr-4Mo-4Cr, Ti-10V-2Fe-3Al, Ti-8Mo-8V-2Fe-3Al, Ti-3Al -8V-6Cr-4Mo-4Zr, Ti-13V-11Cr-3Al, and the like.

The titanium alloy cast article may be prepared using procedures known in the art. Following casting, the cast article may, optionally, be densified by Hot Isostatic Pressing (HIP). Titanium alloys dissolve their own oxides at high temperatures allowing a complete closure of all non-surface-connected voids by diffusion bonding. The Hot Isostatic Pressing of titanium alloys may be carried out at a temperature below the beta-transus temperature of the alloy following known techniques.

Hot Isostatic Pressing can enhance critical mechanical properties such a fatigue resistance, while causing no serious degradation in properties such as fracture toughness, fatigue crack growth rate, and tensile strength. Hot Isostatic Pressing does not, however, heal surface connected voids. Therefore, weld repair is a common practice for filling gas voids, shrinkage pores exposed by chemical milling, post-HIP surface depressions, or cold shuts for applications requiring defect-free components.

The method of the present invention comprises the steps of hydrogenation of a cast article, cooling the hydrogenated article at a controlled rate to about room temperature, dehydrogenating the article and cooling the dehydrogenated article to room temperature.

Following casting, and optionally, hot isostatic pressing, the cast titanium alloy article is first hydrogenated to a level of about 0.5 to 1.5 weight percent hydrogen. Titanium and its alloys have an affinity for hydrogen, being able to dissolve up to about 3 weight percent (60 atomic %) hydrogen at 590° C. While it may be possible to hydrogenate the article to the maximum quantity, it is presently preferred to hydrogenate the article to a level of about 0.5 to 1.5 weight percent hydrogen, to prevent cracking during the subsequent cooling step. The addition of hydrogen is carried out using any suitable apparatus. Because hydrogen is highly flammable, it is presently preferred to carry out the hydrogenation using a mixture of hydrogen and an inert gas, such as argon or helium. A typical composition for a nonflammable gas environment would be a mixture consisting of 96 weight percent argon and four weight percent hydrogen, i.e., hydrogen makes up about 43 volume percent of the gas mixture. The composition of the gas is not critical, but it is preferred that the quantity of hydrogen be less than about 5 weight percent to avoid creation of a flammable mixture. It is also within the scope of this invention to employ a gas mixture containing more than about 5 weight percent hydrogen, as well as pure hydrogen.

The temperature at which the hydrogen is added to the alloy should be near or greater than the titanium-hydrogen eutectoid temperature of 815° C. (1500° F.). In general, the temperature of hydrogen addition can range from about 780° to 1020° C. (1435° to 1870° F.).

Following the hydrogenation step, the article is cooled from the hydrogenation temperature at a controlled rate to about room temperature. The rate is controlled to be about 5° to 40° C. per minute. This controlled rate cooling step is critical to providing the desired microstructure. If the rate is too high, cracking and distortion of the article may result. A slower cooling rate may lead to the formation of a coarse lenticular structure which will not provide satisfactory fatigue properties.

While we do not wish to be held to any particular theory of operation, it is believed that as the hydrogenated article cools, metal hydrides, particularly titanium hydrides, for within the matrix of alpha and beta titanium. Because the metal hydrides have a different volume than the titanium matrix grains, there is initiated localized deformation on a microscopic scale. As a result, when the material is reheated for removal of the hydrogen, the microdeformed regions cause localized recrystallization which results in a low aspect ratio grain structure (see FIG. 2) or breakup of the plate structure (see FIGS. 3 and 4).

Dehydrogenation of the hydrogenated article is accomplished by heating the article under vacuum to a temperature in the range of about 650° to 750° C., (1200° to 1380° F.). The time for the hydrogen removal will depend on the size and cross-section of the article, the volume of hydrogen to be removed, the temperature of dehydrogenation and the level of vacuum in the apparatus used for dehydrogenation. The term "vacuum" is intended to mean a vacuum of about $10^{-2}$ mm Hg or less, preferably about $10^{-4}$ mm Hg or less. The time for dehydrogenation must be sufficient to reduce the hydrogen content in the article to less than the maximum allowable level. For the alloy Ti-6Al -4V, the final hydrogen level must be below 120 ppm to avoid degradation of mechanical properties. Generally, about 15 to 60 minutes at dehydrogenation temperature and under vacuum, is sufficient to ensure substantially complete evolution of hydrogen from the article. Heating is then discontinued and the article is allowed to cool, at the previously described controlled rate, to room temperature.

The following example illustrates the invention.

EXAMPLE

A series of cast Ti-6Al -4V coupons was treated as shown in the following table:

TABLE

| | Hydrogenation | | Dehydrogenation |
|---|---|---|---|
| FIGS. | Temp.(°F.) | Level (wt %) | Temp.(°F.) |
| 1 | — | 0.00 | — |
| 2 | 1450 | 1.00 | 1300 |
| 3 | 1650 | 0.76 | 1300 |
| 4 | 1850 | 0.77 | 1300 |
| 5 | 1450 | 1.00 | — |
| 6 | 1650 | 0.76 | — |

Referring now to the drawing, FIG. 1 illustrates a typical microstructure of cast annealed Ti-6Al -4V. FIG. 1 reveals a relatively large colony of similarly aligned long lenticular alpha plates. The plates are separated by a small amount of continuous intergranular beta phase films.

Figure 2:
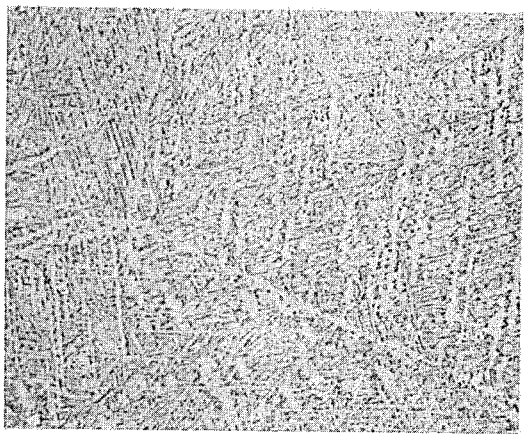

FIG. 2 illustrates the microstructure of a coupon which was hydrogenated at a temperature slightly below the Ti-H entectoid at about 1450° F. to a level of about 1.0 wt% hydrogen, then cooled to room temperature, at the previously specified cooling rate range. The photomicrograph reveals a relatively fine alpha microstructure.

Figure 3:
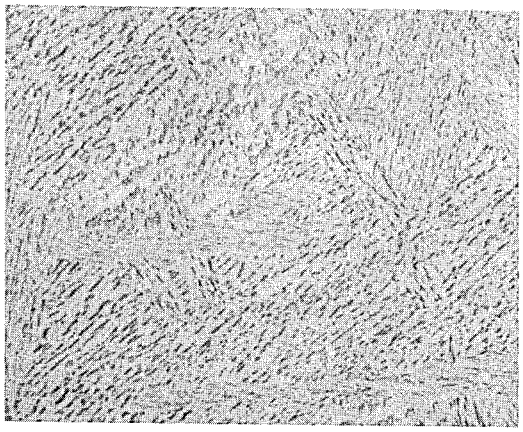

FIG. 3 illustrates the microstructure of a coupon which was hydrogenated and cooled, using the same conditions given for the coupon shown in FIG. 2, then dehydrogenated at about 1300° F. and cooled to room temperature. The photomicrograph reveals a fine alpha microstructure with a relatively low aspect ratio. This microstructure of low aspect ratio alpha is known to be a good structure for high fatigue strength and is entirely different from the untreated cast structure shown in FIG. 1.

Figure 4:
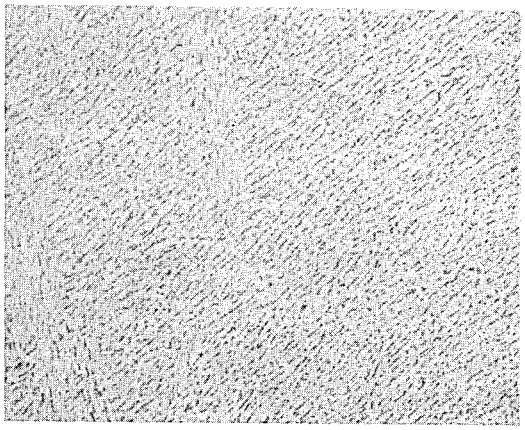

FIG. 4 illustrates the microstructure of a coupon which was hydrogenated above the Ti-H eutectoid temperature at about 1650° F. to a hydrogen level of about 0.76 wt%, then cooled to room temperature. the photomicrograph reveals a fine martensitic structure.

Figure 5:
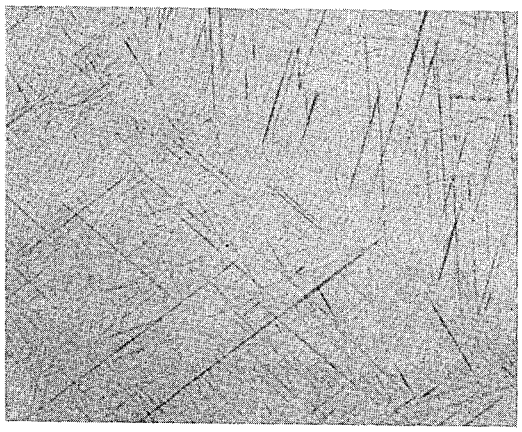

FIG. 5 illustrates the microstructure of a coupon which was hydrogenated and cooled using the same conditions given for the coupon shown in FIG. 4, then dehydrogenated at about 1300° F, then cooled to room temperature. The photomicrograph reveals a fine alpha microstructure with a relatively high aspect ratio, separated by discontinuous films of beta phase. The photomicrograph also reveals retention of the morphology of the martensitic structure of the hydrogenated condition shown in FIG. 4. The fine lenticular alpha structure in a matrix of discontinuous beta phase matrix is known from previous work to be superior in fatigue resistance when compared to the untreated cast structure shown in FIG. 1.

Figure 6:
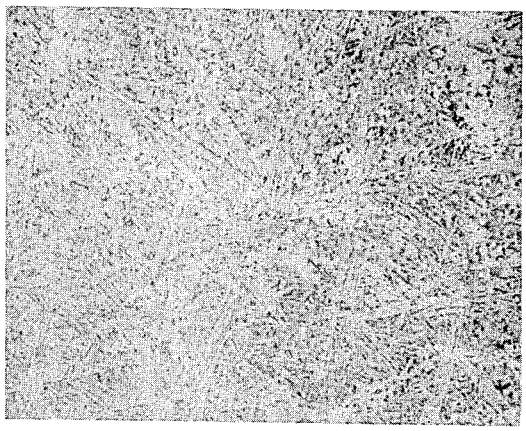

FIG. 6 illustrates the microstructure of a coupon which was hydrogenated above the Ti-H eutectoid at about 1850° F. to a hydrogen level of about 0.77 wt.%, cooled to room temperature, dehydrogenated at about 1300° F, then cooled to room temperature. The photomicrograph reveals a fine alpha microstructure with a relatively high aspect ratio and with retention of the morphology of a martensitic structure.

Various modifications may be made to the present invention without departing from the spirit thereof or the scope of the appended claims.

We claim:

1. A method for improving the microstructure of cast titanium alloy articles which comprises the steps of hydrogenating the cast article at a temperature near or greater than the titanium-hydrogen eutectoid temperature of 815° C., said temperature of hydrogenation being in the range of about 780° to 1020° C. to a hydrogen level of about 0.50 to 1.50 weight percent, cooling the thus-hydrogenated article to room temperature at a controlled rate, heating the thus-cooled, hydrogenated article to a temperature of about 650° to 750° C., applying a vacuum to dehydrogenate the article and cooling said article to room temperature at a controlled rate.

2. The method of claim 1 wherein said controlled cooling rate is about 5° to 40° C. per minute.

3. The method of claim 1 wherein said article is made of Ti-6Al -4V alloy.

4. The method of claim 3 wherein said hydrogenation is carried out at a temperature of about 1450° F. (787° C.) to a hydrogen level of about 1.0 wt. percent and wherein said dehydrogenation is carried out at about 1300° F. (704° C.).

5. The method of claim 3 wherein said hydrogenation is carried out at a temperature of about 1650° F. (899° C.) to a hydrogen level of about 0.76 wt. percent and wherein said dehydrogenation is carried out at about 1300° F. (704° C.).

6. The method of claim 3 wherein said hydrogenation is carried out at a temperature of about 1850° F. (1010° C.) to a hydrogen level of about 0.77 wt. percent and wherein said dehydrogenation is carried out at about 1300° F. (704° C.).

* * * * *

UNITED STATES PATENT AND TRADEMARK OFFICE

CERTIFICATE OF CORRECTION

PATENT NO. : 4,820,360

DATED : April 11, 1989

INVENTOR(S) : Daniel Eylon et al

It is certified that error appears in the above-identified patent and that said Letters Patent is hereby corrected as shown below:

Title page:

In the ABSTRACT, line 4, after "815° C. (", delete "of".

Col 2, line 58, change "thushydrogenated" to ---thus-hydrogenated---.

Col 2, line 62, change "759°" to ---750°---.

Col 4, line 12, after "hydrides,", change "for" to ---form---.

Col 5, line 16, after "temperature.", change "the" to ---The---.

Signed and Sealed this

Sixth Day of February, 1990

*Attest:*

JEFFREY M. SAMUELS

*Attesting Officer*

*Acting Commissioner of Patents and Trademarks*